US005094669A

United States Patent [19]

Herbert et al.

[11] Patent Number: 5,094,669

[45] Date of Patent: Mar. 10, 1992

[54] METHOD OF CONTROLLING THE GASIFICATION OF SOLID FUELS IN A ROTARY-GRATE GAS PRODUCER

[75] Inventors: Peter Herbert, Frankfurt am Main; Gerhard Schmitt, Schmitten, both of Fed. Rep. of Germany

[73] Assignee: Metallgesellschaft Aktiengesellschaft, Frankfurt am Main, Fed. Rep. of Germany

[21] Appl. No.: 579,456

[22] Filed: Sep. 7, 1990

[30] Foreign Application Priority Data

Sep. 8, 1989 [DE] Fed. Rep. of Germany ..... 3929925

[51] Int. Cl.[5] ..... C10J 3/16

[52] U.S. Cl. ..... 48/197 R; 48/66; 48/203; 48/206; 48/210; 48/DIG. 10

[58] Field of Search ..... 48/197 R, 202, 203, 48/206, 210, DIG. 10, 66, 68

[56] References Cited

U.S. PATENT DOCUMENTS 3,930,811 1/1976 Hiller et al. ..... 48/68
3,937,620 2/1976 Rudolph et al. ..... 48/68
4,014,664 3/1977 Kupfer et al. ..... 48/68
4,088,455 5/1978 Kohlen et al. ..... 48/206
4,309,194 1/1982 Salvador et al. ..... 48/203
4,608,059 8/1986 Kupfer eet al. ..... 48/197 R

*Primary Examiner*—Peter Kratz
*Attorney, Agent, or Firm*—Sprung Horn Kramer & Woods

[57] ABSTRACT

In a rotary-grate gas producer operated under a pressure from 10 to 100 bars, the fuel constitutes a fixed bed, which slow descends. The mixture of gasifying agents contains water vapor and oxygen is supplied to the fixed bed through a rotary grate and through an ash layer, which is disposed on the rotary grate. In order to ensure that the ash will have a particle size in a desired range, a first pressure (p1) is measured below the rotary grate and a second pressure (p2) is measured approximately at the top of the ash layer. The pressure difference (p1−p2) is compared with a setpoint, which is associated with the current ratio of water vapor to oxygen in the mixture of gasifying agent. Said ratio is increased when the pressure difference is insufficient and the ratio is decreased if the pressure difference is excessive.

4 Claims, 1 Drawing Sheet

Figure 1:
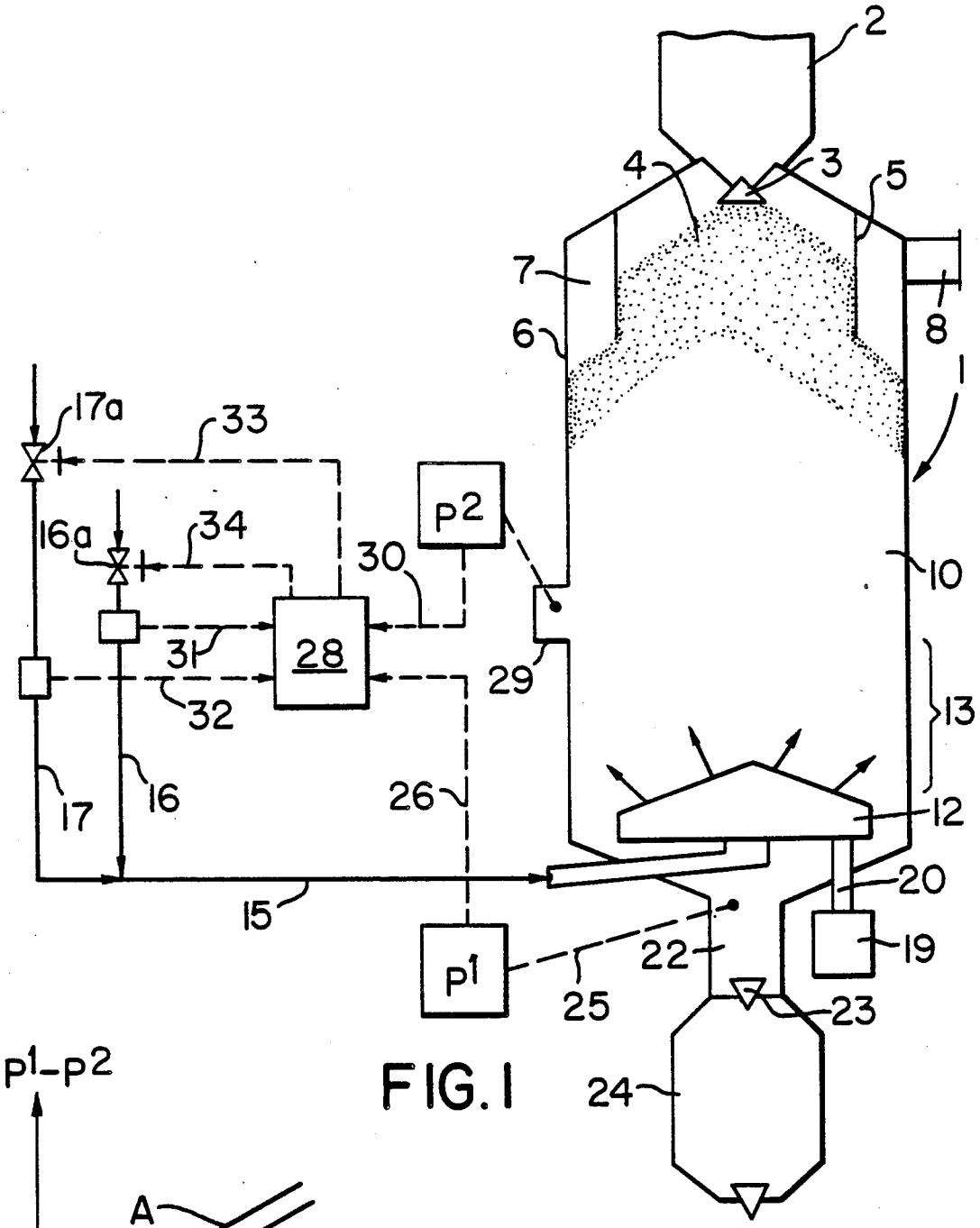

METHOD OF CONTROLLING THE GASIFICATION OF SOLID FUELS IN A ROTARY-GRATE GAS PRODUCER

This invention relates to a method of controlling the gasification of solid fuels in a reactor under a pressure from 10 to 100 bars in a mixture of gasifying agents, which comprise water vapor and oxygen, wherein the fuel in the reactor constitutes a fixed bed, which slowly descends, the mixture of gasifying agents flows into the fixed bed through a rotary grate and through an ash layer provided on the rotary grate, and ash is withdrawn under the rotary grate.

The gasification of granular coal is known and has been explained, e.g., in Ullmanns Encyklopädie der Technischen Chemie, 4th edition (1977), volume 14, on pages 383–386. Details of the design of the reactor and of the associated rotary grate are apparent from German Patents 23 51 963, 23 46 833, 25 24 445 and Published German Application 26 07 964 and from the corresponding U.S. Pat. Nos. 3,930,811; 3,937,620; 4,014,664 and 1,088,455.

The gasification reactor is generally fed with coal in particle sizes from about 3 to 70 mm; a certain proportion of finer coal is permissible. The gasifying process will result in the formation of an ash layer over the rotary grate because that region is supplied with oxygen for the combustion of the so-called residual coke. In that combustion zone the sensible heat is generated which is required for the endothermic gasifying reactions performed in the overlying gasification region. For this reason the height of the ash layer can be determined by a measurement of the varying temperature in the fixed bed. The height of the ash layer will be influenced by the speed of the rotary grate and said speed can be adjusted manually or by an automatic control. An automatic control of the speed of the rotary grate is described in Published German Application 33 33 070 and in the corresponding U.S. Pat. No. 4,608,059.

Experience obtained in the operation of rotary-grate gas producers reveals that the particle size distribution of the ash which is formed may vary greatly as a result of fluctuations of the melting behavior and melting point of the ash. The consistency of the ash which is formed will decisively depend on the current melting behavior of the ash and on the temperature in the combustion zone. Ash consisting of coarse lumps or clinker will be formed at temperatures above the melting point. A fine to powderlike ash will mainly be formed at temperatures below the softening temperature of the ash. The temperature in the combustion zone will depend on the ratio of the rates at which water vapor and oxygen are supplied. Water vapor may be replaced in part by $CO_2$. An increase of the proportion of oxygen will result in a higher temperature in the ash-forming combustion zone. An increase of the proportion of water vapor or $CO_2$ will result in a decrease of that temperature.

The optimum particle size of the ash lies in the range from 1 to 60 mm. If the ash disposed over the rotary grate has an excessively small particle size and is, e.g., powderlike, the ash layer will be insufficiently permeable to gas and this may have the result that the fixed bed is raised by the gas pressure of the mixture of gasifying agents. Ash consisting of excessively large lumps will also be undesirable because it can be discharged only with difficulty and will shorten the life of the rotary grate and will result in a poor distribution of the gasifying agent and will increase the power required to drive the rotary grate. For this reason it is an object of the invention to permit an adjustment of the particle size of the ash being formed so as to keep said particle size within a desired range by a control which is as simple as possible.

In the process described first hereinbefore, that object is accomplished in accordance with the invention in that a first pressure (pl) is measured in the reactor below the rotary grate, a second pressure (p2) is measured in the reactor adjacent to the top of the ash layer, the pressure difference (p1−p2) which is calculated from said pressures is compared with a setpoint, which is associated with the instantaneous ratio of water-vapor to oxygen in the mixture of gasifying agents, said ratio is increased when the pressure difference is insufficient and said ratio is decreased when the pressure difference is excessive. The pressure difference (p1−p2) is a measure of the permeability of the ash layer to gas and, as a result, is also a measure of the particle size distribution in the ash layer during a given gas-producing process. The control may be effected manually or by automatic control. Because small fluctuations of the pressure difference (p1−p2) may generally be tolerated, the desired value is usually constituted by a setpoint range.

The mixture of gasifying agents used for a gasification of coal in a fixed bed usually contains 4 to 9 kg, preferably 5 to 7 kg water vapor per standard cubic meter ($sm^3$) of oxygen. The water vapor may be replaced entirely or in part by $CO_2$. If the water vapor content is insufficient, the higher proportion of oxygen will result in the formation of an ash which consists of coarse lumps or clinker-like agglomerates and will also result in an insufficient pressure difference (p1−p2). On the other hand, an excessive water vapor content will result in a formation of a gritty to powderlike ash and this will be indicated by an increase of the pressure difference (p1−p2).

When an ash having a desired consistency is formed in conventional gasification reactors, the pressure-difference (p1−p2) will lie in the range from 3 to 30 kPA. But the desired value used for the control must specifically be determined for the gasification reactors of each type during a trial operation. In that case, care is suitably taken that the kind and also the particle size of the coal as well as the qualities of the water vapor and oxygen remain substantially constant.

Figure 2:
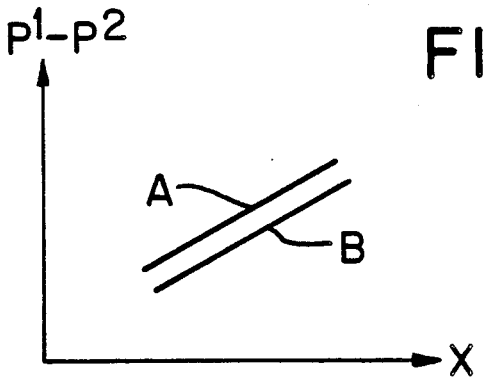

Details of the control will be explained with references to the drawing, in which FIG. 1 is a diagrammatic representation of the gasification reactor provided with control means and FIG. 2 illustrates the setpoint range used for the control.

The pressurized gasification reactor 1 is supplied with granular fuel, particularly coal, from a lock chamber 2, which is shown only in part, and through a periodically opened shut-off device 3. That fuel first enters a supply region 4, which is confined by a cylindrical wall 5. A solids-free gas-collecting chamber 7 is disposed between the wall 5 and the shell 6 of the reactor. Product gas is withdrawn from the collecting chamber 7 through a discharge duct 8.

The supply region 4 is open at its bottom and communicates with the fixed bed 10, which slowly descends as the coal is consumed. An ash layer 13 is disposed over a rotary grate 12, which serves also to distribute the mixture of gasifying agents which is supplied to the fixed bed 10. The upper portion of the ash layer 13 merges gradually into the bed of fuel. The mixture of gasifying agents is supplied to the rotary grate 12 by the line 15, which is supplied with oxygen through line 16 and with water vapor through line 17. The rotary grate is driven by a motor 19 and by the shaft 20.

As a result of the rotation of the rotary grate 12, part of the ash is continuously moved downwardly into the ash duct 22 and flows from the latter through a periodically opened shut-off device 23 into the container 24 of the ash lock, from which the ash is withdrawn in batches.

In order to maintain a desired particle size of the ash in the ash layer 13, the pressure pl is measured below the rotary grate 12 in the solids-free upper portion of the ash duct 22, as is indicated by the signal line 25, which is represented by a dotted line. For the sake of simplicity, the pressure gauge is also designated p1. The measured pressure p1 is indicated via the signal line 26 to a controller 28. A second pressure p2 is measured in a solids-free measuring chamber 29 adjacent to the top of the ash layer 13. Via a signal line 30 the pressure p2 is also indicated to the controller 28. Besides, the controller 28 is supplied via the signal line 31 with information on the rate of flow of oxygen in line 16 and via the signal line 32 with information on the rate of flow of water vapor in line 17. In the controller, the calculated pressure difference p1−p2 is compared with the setpoint range which is associated with the instantaneous rate of flow of oxygen in line 16. When a formation of excessively coarse ash is indicated by an insufficient pressure difference, the ratio of water vapor to oxygen in the mixture of gasifying agents flowing in line 15 will be increased. To that end, the proportion of water vapor will be increased in that the controller 28 effects via the signal line 33 an adjustment of the control valve 17*a*. In case of an excessive pressure difference p1−p2, a control in the opposite sense will analogously be effected.

FIG. 2 illustrates the setpoint range between the boundary lines A and B, which must be provided as previously stored information in the controller 28. The optimum range between the boundary lines A and B lies in the plane which is defined by the X coordinates representing the rate of oxygen (e.g., in $sm^3/h$) and by the pressure difference p1−p2. The area of excessively fine ash lies above the line A and the area of excessively coarse ash lies under the line B. The boundary lines might alternatively be curved. The control range which is employed for conventional gasification reactors is from about 4 to 9 kg water vapor per $sm^3$ oxygen. The oxygen consumption is a measure of the rate of product gas on a dry basis.

EXAMPLE

A system as shown in FIG. 1 of the drawing is operated as follows:

Coal having a particle size range from 4 to 60 mm is fed to the gasification reactor 1. The uppermost melting point of the coal ash is 1500° C. and the lowermost melting point of the ash is at about 1300° C. The gasification is effected under a pressure of 28 bars. The reactor has an inside diameter of 3.8 meters. The fixed bed has a height of 6 meters, measured from the bottom surface of the rotary grate 12 to the bottom edge of the cylindrical wall 5. The pressure p2 is measured at a point which is 2 meters above the bottom surface of the rotary grate 12. That distance is also the height of the ash layer The performance of the reactor may be indicated by the consumption of coal (in metric tons per hour), by the consumption of oxygen (in $sm^3/h$) or by the rate at which dry raw gas is produced (in $sm^3/h$). The three parameters are directly interrelated. In the present case, $O_2$ consumption = 224 × coal consumption and $O_2$ consumption = 14 × product gas rate, dry if the $O_2$ consumption and the product gas rate are measured in $sm^3/h$ and the coal consumption is measured in metric tons per hour.

In the calibration chart corresponding to the graph shown in FIG. 2, the oxygen consumption is plotted along the X axis. During the trial operation of the gasification reactor, the highest permissible values of the pressure difference p1−p2 (on line A) and the lowest permissible values of that pressure difference (on line B) are determined which are associated with various values of the oxygen consumption. Various values are apparent from the following Table:

TABLE

| $O_2$ consumption ($sm^3/h$) | 3750 | 5000 | 6260 | 7500 |
|---|---|---|---|---|
| A (kPa) | 3.5 | 5.5 | 7.8 | 10.8 |
| B (kPa) | 3.9 | 4.1 | 6.2 | 8.5 |

The setpoint range will be defined in the graph by straight lines which connect said individual values for A and B, respectively.

When that calibration chart is employed and a pressure difference p1−p2 of 11 kPa is measured at an oxygen consumption of, e.g., 7500 $sm^3/h$, this means that the pressure difference exceeds the limiting value A of 10.8 kPa and indicates that the ash in the ash layer 13 is too fine. Whereas the oxygen consumption is not changed, the water vapor supply rate is decreased so that the temperature in the ash layer rise and, as a result, a coarser ash is formed and the pressure difference decreases to or somewhat below 10.8 kPa. In the example, the water vapor content of the mixture of gasifying agents has been varied in the range from 5 to 7 kg per $sm^3$ oxygen. Those limits have been selected in order to allow for the fluctuating melting behavior of the coal ash.

We claim:

1. A method of controlling the gasification of solid fuels in a reactor under a pressure from 10 to 100 bars in a mixture of gasifying agents, which comprise water vapor and oxygen, wherein the fuel in the reactor constitutes a fixed bed, which slowly descends, the mixture of gasifying agents flows into the fixed bed through a rotary grate and through an ash layer provided on the rotary grate, and ash is withdrawn under the rotary grate, characterized in that a first pressure (p1) is measured in the reactor below the rotary grate, a second pressure (p2) is measured in the reactor adjacent to the top of the ash layer, the pressure difference (p1−p2) which is calculated from said pressures is compared with a setpoint, which is associated with the instantaneous ratio of water vapor to oxygen in the mixture of gasifying agents, said ratio is increased when the pressure difference is insufficient and said ratio is decreased when the pressure is excessive.

2. A method according to claim 1, characterized in that the rate of oxygen is kept constant and the proportion of water vapor in the mixture of gasifying agents is increased when the pressure difference is insufficient.

3. A process according to claim 1, characterized in that the oxygen rate is kept constant and the proportion of water vapor in the mixture of gasifying agents is decreased when the pressure difference is excessive.

4. A process according to claim 1, characterized in that ash having a particle size in the range form 1 to 60 mm is withdrawn below the rotary grate.

* * * * *